US008187984B2

(12) United States Patent
Rock

(10) Patent No.: US 8,187,984 B2
(45) Date of Patent: May 29, 2012

(54) TEMPERATURE RESPONSIVE SMART TEXTILE

(75) Inventor: Moshe Rock, Brookline, MA (US)

(73) Assignee: Malden Mills Industries, Inc., Lawrence, MA (US)

( * ) Notice: Subject to any disclaimer, the term of this patent is extended or adjusted under 35 U.S.C. 154(b) by 715 days.

(21) Appl. No.: 11/740,716

(22) Filed: Apr. 26, 2007

(65) Prior Publication Data

US 2008/0075850 A1 Mar. 27, 2008

Related U.S. Application Data

(60) Provisional application No. 60/804,334, filed on Jun. 9, 2006.

(51) Int. Cl.
*B32B 27/12* (2006.01)

(52) U.S. Cl. ..... 442/64; 442/59; 442/60

(58) Field of Classification Search ..... 442/60, 442/59, 64

See application file for complete search history.

(56) References Cited

U.S. PATENT DOCUMENTS

| | | | |
|---|---|---|---|
| 179,661 | A | 7/1876 | Lee |
| 308,244 | A | 11/1884 | Fishel |
| 601,489 | A | 3/1898 | Tim |
| 1,118,792 | A | 11/1914 | Nicholas |
| 1,252,187 | A | 1/1918 | Shane |
| 1,350,169 | A | 8/1920 | Mullane |
| 1,973,419 | A | 9/1934 | Trageser |
| 2,391,535 | A | 12/1945 | Zelano |
| D170,723 | S | 10/1953 | Secosky et al. |
| 2,715,226 | A | 8/1955 | Weiner |
| 3,045,243 | A | 7/1962 | Lash et al. |
| 3,078,699 | A | 2/1963 | Huntley |
| 3,086,215 | A | 4/1963 | Di Paola |
| 3,153,793 | A | 10/1964 | Lepore |
| 3,265,529 | A | 8/1966 | Caldwell et al. |
| 3,296,626 | A | 1/1967 | Ludwikowski |
| 3,458,390 | A | 7/1969 | Ando et al. |
| 3,594,262 | A | 7/1971 | Magidson |
| 3,607,591 | A | 9/1971 | Hansen |
| 3,626,714 | A | 12/1971 | Blore |
| 3,710,395 | A | 1/1973 | Spano et al. |
| 3,737,368 | A | 6/1973 | Such et al. |
| 3,761,962 | A | 10/1973 | Myers |
| 3,801,987 | A | 4/1974 | Thompson, Jr. |
| 3,857,753 | A | 12/1974 | Hansen |
| 3,931,067 | A | 1/1976 | Goldberg et al. |
| 3,971,234 | A | 7/1976 | Taylor |
| 4,126,903 | A | 11/1978 | Horton |

(Continued)

FOREIGN PATENT DOCUMENTS

| | | |
|---|---|---|
| DE | 1 435 981 | 3/1969 |

(Continued)

OTHER PUBLICATIONS

Anonymous, "adidas Clima Cool"; Internet Article, dated Jul. 12, 2005.

(Continued)

*Primary Examiner* — Peter Y Choi

(74) *Attorney, Agent, or Firm* — Fish & Richardson P.C.

(57) ABSTRACT

A textile fabric includes a smooth surface with one or more regions having coating material exhibiting thermal expansion or contraction in response to change in temperature, adjusting insulation performance of the textile fabric in response to ambient conditions.

80 Claims, 8 Drawing Sheets

U.S. PATENT DOCUMENTS 4,185,327 A 1/1980 Markve
4,195,364 A 4/1980 Bengtsson et al.
4,267,710 A 5/1981 Imamichi
4,275,105 A 6/1981 Boyd et al.
4,351,874 A 9/1982 Kirby
4,392,258 A 7/1983 O'Neill
4,418,524 A 12/1983 Ito et al.
4,513,451 A 4/1985 Brown
4,541,426 A 9/1985 Webster
4,608,715 A 9/1986 Miller et al.
4,619,004 A 10/1986 Won
4,638,648 A 1/1987 Gajjar
4,722,099 A 2/1988 Kratz
4,804,351 A 2/1989 Raml et al.
4,807,303 A 2/1989 Mann et al.
4,887,317 A 12/1989 Phillips et al.
4,895,751 A 1/1990 Kato et al.
4,896,377 A 1/1990 Ferdi
4,996,723 A 3/1991 Huhn et al.
5,033,118 A 7/1991 Lincoln
5,095,548 A 3/1992 Chesebro, Jr.
5,105,478 A 4/1992 Pyc
5,192,600 A 3/1993 Pontrelli et al.
5,206,080 A 4/1993 Tashiro et al.
5,211,827 A 5/1993 Peck
5,232,769 A 8/1993 Yamato et al.
5,282,277 A 2/1994 Onozawa
5,366,801 A * 11/1994 Bryant et al. ..... 442/131
5,367,710 A 11/1994 Karmin
5,469,581 A 11/1995 Uthoff
5,515,543 A 5/1996 Gioello
5,582,893 A 12/1996 Bottger et al.
5,636,533 A 6/1997 Hunneke et al.
5,645,924 A 7/1997 Hamilton
5,659,895 A 8/1997 Ford, Jr.
5,683,794 A 11/1997 Wadsworth et al.
5,704,064 A 1/1998 van der Sleesen
5,722,482 A 3/1998 Buckley
5,727,256 A 3/1998 Rudman
5,735,145 A 4/1998 Pernick
5,763,335 A 6/1998 Hermann
5,787,502 A 8/1998 Middleton
5,792,714 A 8/1998 Schindler et al.
5,809,806 A 9/1998 Yoon et al.
5,834,093 A 11/1998 Challis et al.
5,836,533 A 11/1998 Hallamasek
5,853,879 A 12/1998 Takamiya et al.
5,856,245 A 1/1999 Caldwell et al.
5,868,724 A 2/1999 Dierckes, Jr. et al.
5,869,172 A 2/1999 Caldwell
5,874,164 A 2/1999 Caldwell
5,887,276 A 3/1999 Lee
5,901,373 A 5/1999 Dicker
5,908,673 A 6/1999 Muhlberger
5,912,116 A 6/1999 Caldwell
5,925,441 A 7/1999 Blauer et al.
5,939,485 A 8/1999 Bromberg et al.
5,955,188 A 9/1999 Pushaw
6,015,764 A 1/2000 McCormack et al.
6,018,819 A 2/2000 King et al.
6,025,287 A 2/2000 Hermann
6,040,251 A 3/2000 Caldwell
6,061,829 A 5/2000 Gunn
6,066,017 A 5/2000 Max et al.
6,083,602 A 7/2000 Caldwell et al.
6,110,588 A 8/2000 Perez et al.
6,211,296 B1 4/2001 Frate et al.
6,241,713 B1 6/2001 Gross et al.
6,248,710 B1 6/2001 Bijsterbosch et al.
6,253,582 B1 7/2001 Driggars
6,268,048 B1 7/2001 Topolkaraev et al.
6,279,161 B1 8/2001 Johnston
6,308,344 B1 10/2001 Spink
6,312,784 B2 11/2001 Russell et al.
6,319,558 B1 11/2001 Willemsen
6,319,599 B1 * 11/2001 Buckley ..... 428/308.4
6,332,221 B1 12/2001 Gracey
6,339,845 B1 1/2002 Burns et al.
6,361,451 B1 3/2002 Masters et al.
D457,709 S 5/2002 Davis
6,403,216 B1 6/2002 Doi et al.
6,430,764 B1 8/2002 Peters
6,488,872 B1 12/2002 Beebe et al.
6,521,552 B1 2/2003 Honna et al.
6,550,341 B2 4/2003 von Schoor et al.
6,550,474 B1 4/2003 Anderson et al.
6,640,715 B1 11/2003 Watson et al.
6,647,549 B2 11/2003 McDevitt et al.
6,698,510 B2 3/2004 Serra et al.
6,723,378 B2 4/2004 Hrubesh et al.
6,723,967 B2 * 4/2004 Rock et al. ..... 219/528
6,726,721 B2 4/2004 Stoy et al.
D491,713 S 6/2004 Wilson, II
6,756,329 B1 6/2004 Umino et al.
6,766,817 B2 7/2004 da Silva
6,767,850 B1 7/2004 Tebbe
6,770,579 B1 8/2004 Dawson et al.
6,787,487 B1 9/2004 Takeda et al.
6,802,216 B2 10/2004 von Schoor et al.
6,812,268 B2 11/2004 Schneider et al.
6,855,422 B2 2/2005 Magill et al.
6,918,404 B2 7/2005 Dias da Silva
6,927,316 B1 8/2005 Faries, Jr. et al.
7,066,586 B2 6/2006 da Silva
2002/0132540 A1 9/2002 Soerens et al.
2002/0164474 A1 11/2002 Buckley
2002/0189608 A1 12/2002 Raudenbush
2003/0010486 A1 1/2003 Serra et al.
2003/0087566 A1 5/2003 Carlyle et al.
2003/0114810 A1 6/2003 Weber
2003/0182705 A1 10/2003 Spongberg
2003/0208831 A1 11/2003 Lazar et al.
2004/0024092 A1 2/2004 Soerens et al.
2004/0025985 A1 2/2004 von Schoor et al.
2004/0033743 A1 * 2/2004 Worley et al. ..... 442/59
2004/0131838 A1 7/2004 Serra et al.
2004/0132367 A1 7/2004 Rock
2004/0158910 A1 8/2004 Bay
2004/0176005 A1 9/2004 Nordstrom
2005/0053759 A1 * 3/2005 Rock et al. ..... 428/91
2005/0204448 A1 9/2005 Wise et al.
2005/0204449 A1 9/2005 Baron et al.
2005/0208266 A1 9/2005 Baron et al.
2005/0208283 A1 9/2005 Baron et al.
2005/0208850 A1 9/2005 Baron et al.
2005/0208857 A1 9/2005 Baron et al.
2005/0208859 A1 9/2005 Baron et al.
2005/0208860 A1 9/2005 Baron et al.
2005/0246813 A1 11/2005 Davis et al.
2005/0250400 A1 11/2005 Hsu
2006/0179539 A1 8/2006 Harber
2006/0223400 A1 10/2006 Yasui et al.
2006/0277950 A1 12/2006 Rock
2008/0057261 A1 3/2008 Rock
2008/0057809 A1 3/2008 Rock

FOREIGN PATENT DOCUMENTS

DE 27 02 407 7/1978
DE G 85 33 733.1 5/1986
DE 196 19 858 11/1997
EP 826083 4/2000
EP 1 050 323 11/2000
EP 1054095 11/2000
EP 826082 3/2001
EP 1 329 167 7/2003
EP 1 752 571 2/2007
EP 1 306 475 3/2007
EP 1 803 844 7/2007
GB 2 108 822 A 5/1983
GB 2 193 429 A 2/1988
GB 2254044 9/1992
GB 2333724 7/2002
GB 2 403 146 12/2004
JP 60-252746 12/1985
JP 60-252756 12/1985
JP 61-216622 9/1986
JP 62-162043 7/1987

| | | |
|---|---|---|
| JP | 8-113804 | 7/1996 |
| JP | 2001-49513 | 2/2001 |
| JP | 2002-180342 | 6/2002 |
| JP | 2003-41462 | 2/2003 |
| JP | 2004-360094 | 12/2004 |
| JP | 2005-36374 | 2/2005 |
| SE | 198 705 | 3/1965 |
| WO | 91/09544 | 7/1991 |
| WO | 92/16434 | 10/1992 |
| WO | 99/05926 | 2/1999 |
| WO | WO2004/011046 | 2/2004 |
| WO | 2004/113599 | 12/2004 |
| WO | 2004/113601 | 12/2004 |
| WO | WO2005/007962 | 1/2005 |
| WO | 2005/010258 | 2/2005 |
| WO | 2005/038112 | 4/2005 |
| WO | 2005/095692 | 10/2005 |
| WO | 2005/110135 | 11/2005 |
| WO | WO2006/002371 | 1/2006 |
| WO | 2006/041200 | 4/2006 |
| WO | 2006/043677 | 4/2006 |
| WO | 2006/044210 | 4/2006 |
| WO | WO2006/035968 | 4/2006 |
| WO | 2006/090808 | 8/2006 |

OTHER PUBLICATIONS

Anonymous, "Apparal-Adidas", Internet Article, dated Apr. 21, 2004.
Anonymous, "Loughborough University and adidas join forces to help Olympians beat the heat in Athens", Internet Article, dated Jul. 7, 2004.
International Search Report in corresponding PCT application; International Application No. PCT/US2005/035831, mailed Jan. 26, 2006.
International Search Report in corresponding PCT application; PCT application No. PCT/US2005/005191, mailed Jun. 6, 2005.
Internet printout: http://niketown.nike.com/ Nike Pro Vent Dri-FIT Long Sleeve Top; dated Mar. 22, 2004.
Internet printout: http://niketown.nike.com/ Nike Pro Vent Dri-FIT Short-Sleeve Top, dated Mar. 22, 2004.
Internet printout: http://niketown.nike.com: Dri-FIT One Long Short, dated Mar. 22, 2004.
Internet printout: http://niketown.nike.com: Dri-FIT One Mesh Tank; dated Mar. 22, 2004.
Internet printout: http://niketown.nike.com: Global Nike Sphere Polo, dated Apr. 9, 2004.
Internet printout: http://niketown.nike.com: Global Nike Sphere Top, dated Apr. 9, 2004.
Internet printout: http://niketown.nike.com: Nike Sphere Dry Crew, dated Apr. 9, 2004.
Internet printout: http://niketown.nike.com: Nike Sphere Switchback Long-Sleeve, dated Mar. 22, 2004.
Internet printout: http://niketown.nike.com: Nike Sphere Switchback Short- Sleeve, dated Apr. 9, 2004.
Internet printout: http://niketown.nike.com: Nike Sphere Switchback Long- Sleeve, dated Apr. 9, 2004.
Internet printout: http://niketown.nike.com: Nike Sphere Ultralight Top, dated Apr. 9, 2004.
Internet printout: http://niketown.nike.com: Nike Sphere Ultralight Tank, dated Mar. 22, 2004.
Internet printout: http://niketown.nike.com: Nike Sphere Ultralight Tank, dated Apr. 9, 2004.
Internet printout: http://niketown.nike.com: Nike Sphere Warm-Up, dated Apr. 9, 2004.
Internet printout: http://niketown.nike.com: Nike Sphere Yoked Sleeveless Top, dated Apr. 9, 2004.
Internet printout: http://niketown.nike.com: Nike Sphere Yoked Short-Sleeve Top, dated Apr. 9, 2004.
Internet printout: http://niketown.nike.com: UV Dri-Fit Long-Sleeve Top, dated Mar. 22, 2004.
Internet printout: http://niketown.nike.com: Nike Pro Vent Dri-FIT Sleeveless Top; dated Mar. 22, 2004.
Internet printout: http://realtvtimes.com—Agent News and Advice, dated Mar. 24, 2004.
Mitsubishi rayon: Changeable fiber stretches with moisture; Asian Textile Business; Sep. 1, 2003.
Regenold, "Look cool in hot times with Eco-Mesh", Internet Article, dated Apr. 17, 2004.
Weisey, "Grand Canyon Hike", Internet Article; dated Jun. 26, 2000.
Communication under 37 Cfr 1.56(d) from Elson Silva, dated Mar. 24, 2008.
Hatch, Kathryn L., "Textile Science," West Publishing, 1993, p. 61.
Sidawi, Danielle, "Smart Materials Respond to Changing Environments," R&D Magazine (On-Line Posting). Accessed May 10, 2005 http://rdmag.com ((8pp. including 4pp. article+4pp. full text).
European Search Report; corresponding Application EP 07253370; dated Mar. 12, 2008; 8pp.
European Search Report Application No. EP 07 25 3372 dated Jan. 1, 2008, 6pp.

* cited by examiner

TEMPERATURE RESPONSIVE SMART TEXTILE

CROSS-REFERENCE TO RELATED APPLICATIONS

This application claims benefit from U.S. Provisional Patent Application 60/804,334, filed Jun. 9, 2006.

TECHNICAL FIELD

This invention relates to textile fabrics, and more particularly to textile fabrics responsive to change in ambient temperature.

BACKGROUND

Standard textile fabrics have properties set during fabric construction that are maintained despite changes in ambient conditions and/or physical activity. These standard products are quite effective, especially when layered with other textile fabrics for synergistic effect and enhancement of comfort.

SUMMARY

According to one aspect, a textile fabric includes a smooth-surface with one or more regions of a first coating material exhibiting thermal expansion or contraction in response to change in temperature, adjusting insulation performance of the textile fabric in response to ambient conditions.

Preferred implementations may include one or more of the following additional features. The textile fabric cars include one or more regions of a second coating material overlying one or more regions of the first coating material, the first coating material together with the second coating material forming a bi-component coating at the smooth surface of the textile fabric. The second coating material may be chemically and/or physically bonded to the first coating material. The second coating material is disposed on a first surface of the first coating material opposite the smooth surface of the textile fabric. The first coating material and the second coating material exhibit differential thermal expansion to cause a change in a three dimensional configuration of the textile fabric in response to change in temperature. The first coating material and the second coating material exhibit differential thermal expansion in response to change in temperature over a predetermined temperature range. In some cases, the predetermined temperature range is between about −40° F. and about 140° F. In some examples, the predetermined temperature range is between about 50° F. and about 100° F. In other examples, the predetermined temperature range is between about −40° F. and about 60° F., e.g., between about −20° F. and about 40° F. The first coating material may be a polymer, such as polyurethane. The polymer exhibits volume change by crystallization. The polymer is configured to crystallize at a temperature of between about −40° F. and about 100° F. For example, in some cases, the polymer is configured to crystallize at a temperature of between about 50° F. and about 100° F., e.g., between about 60° F. and about 98° F., e.g., between about 69° F. and about 73° F. In another example, the polymer is configured to crystallize at a temperature of between about −40° F. and about 60° F., e.g., between about −20° F. and about 40° F.

The second, coating material comprises polymer, selected, e.g., from the group consisting of: polyurethanes, silicones, and acrylates. In some embodiments, one or more regions of the second coating material are disposed on the smooth surface of the textile fabric, and the first coating material overlies one or more regions of the second coating material. In some eases, the first coating material is arranged in overlapping relationship with the second coating material such that at least a portion of the first coating material contacts the smooth surface of the textile fabric. The textile fabric includes one or more regions of a second material disposed in side-by-side relationship with the first coating material on the smooth surface of the textile fabric. The textile fabric has a circular knit construction, warp knit construction, and/or woven construction. In any of the above knit constructions, elastic yarn may be added (e.g., spandex such as Lycra® or Lycra® T-400) to, e.g., the stitch yarn. The spandex yarn can include, for example, bare spandex yarn, core spun yarn, wrap yarn, and/or air entangled yarn. The circular knit construction is formed in single jersey construction, double knit construction, or terry sinker loop construction. The terry sinker loop is formed in plaited construction. The terry sinker loop is formed in reverse plaited construction. The terry sinker loop may be raised by napping or may remain in an un-napped condition. The first coating material is disposed in a plurality of predetermined discrete regions on the smooth surface of the textile fabric. The plurality of predetermined discrete regions may be in the form of discrete dots. The first coating material covers between about 5% and about 80% of the surface area of the smooth surface.

According to another aspect, a method of forming a temperature responsive textile fabric element for use in an engineered thermal fabric garment includes combining yarns and/or fibers to form a continuous web; finishing the continuous web to form at least one smooth surface; and depositing first coating material on the smooth surface, the first coating material exhibiting thermal expansion or contraction in response to change in temperature, adjusting insulation performance of the textile fabric in response to ambient conditions.

Preferred implementations may include one or more of the following additional features. The step of combining yarn and/or fibers in a continuous web includes combining yarn and/or fibers by circular knitting to form a circular knit fabric. The step of combining yarn and/or fibers in a continuous web by circular knitting includes combining yarn and/or fibers by reverse plaiting. The step of finishing includes finishing one surface of the continuous web; to form a terry sinker loop construction. The step of combining yarn and/or fibers in a continuous web by circular knitting includes combining yarn and/or fibers by plaiting. The step of finishing includes finishing one surface of the continuous web to form a terry sinker loop construction. The step of finishing includes finishing the continuous web to form a single jersey construction. The step of finishing includes finishing the continuous web to form a double knit construction. The step of combining yarn and/or fibers in a continuous web includes combining yarn and/or fibers by warp knitting. The step of combining yarn and/or fibers in a continuous web includes combining yarn and/or fibers to form a woven fabric element. The step of depositing the first coating material includes depositing the first coating material in one or more discrete regions on the smooth surface of the textile fabric. The one or more discrete regions are disposed in a pattern corresponding to predetermined areas on an engineered thermal fabric garment typically subjected to relatively high levels of liquid sweat. The predetermined discrete regions are in the form of a plurality of discrete dots. The step of depositing the first coating material includes depositing the first coating material over substantially the entire smooth surface of the textile fabric. The method can include depositing second coating material to overlie the first coating material, thereby forming a bi-component coating at the smooth surface of the textile fabric, wherein the first coating material and the second coating material exhibit differential thermal expansion to cause change in a three dimensional configuration of the textile fabric in response to change in temperature. The second coating material may be bonded to the first coating material, e.g., with a chemical and/or physical bond. The method may also include drying the first coating material prior to depositing the second coating material. In some cases, depositing the second coating material comprises depositing the second coating material to overlie one or more regions of the first coating material. The step of depositing the second coating material may include depositing the second coating material to overlie one or more regions of the first coating material such that at least a portion of the second coating material is disposed upon the smooth surface of the textile fabric (e.g., for bonding at least a portion of the second coating material to the surface of the textile fabric). The step of depositing the second coating material includes depositing the second coating material in side-by-side relationship with the first coating material on the smooth surface of the textile fabric. At least one of the first and second coating materials include crystallizing polymer. Depositing the first coating material includes depositing the first coating material by a process selected from the group consisting of: coating, lamination, and printing. Printing includes hot melt printing, gravure roll printing, screen printing, or hot melt gravure roll (i.e., hot melt by gravure roll application).

In yet another aspect, a temperature responsive textile fabric garment includes a thermal fabric having a smooth outer surface and a plurality of discrete regions of first coating material. The plurality of discrete regions of the first coating material are disposed in a pattern corresponding to one or more predetermined regions of a user's body. The first coating material exhibits thermal expansion or contraction in response to change in temperature, thereby adjusting insulation performance of the textile fabric in response to ambient conditions.

Preferred implementations may include one or more of the following additional features. The first coating material comprises shape memory polymer. The shape memory polymer exhibits volume change by crystallization. The shape memory polymer is configured to crystallize at a temperature of between about −40° F. and about 100° F. For example, in some cases, the shape memory polymer is configured to crystallize at a temperature of between about 60° F. and about 98° F., e.g., between about 69° F. and about 73° F. In another example, the shape memory polymer is configured to crystallize at a temperature of between about −40° F. and about 60° F., e.g., between about −20° F. and about 40° F. The shape memory polymer is polyurethane. The textile fabric garment may be in the form of an article of outerwear, e.g., for use in relatively lower temperature environments (e.g., between about −40° F. and about 60° F.). For example, the textile fabric garment may be in the form of a jacket and/or outer shell. In some cases, for example, the thermal fabric is a substantially flat outer shell material, wherein the shape memory polymer exhibits expansion and/or contraction in response to change in temperature to cause change in a two-dimensional planar configuration of the thermal fabric in response to change in temperature, thereby increasing insulation performance of the textile fabric garment in response to a decrease in temperature. The thermal fabric can include spandex yarn or high stretch synthetic yarn for enhanced fit, comfort, and shape recovery (e.g., to aid in the reversibility of three dimensional changes in configuration of the thermal fabric). For example, in some cases, the spandex is incorporated in the stitch (e.g., in the form of bare spandex yarn, air entangled yarn, core-spun yarn, and/or wrap yarn, etc.). A plurality of discrete regions of a second coating material are disposed adjacent and corresponding to the plurality of discrete regions of the first costing material, wherein the first coating material and the second coating material exhibit differential thermal expansion to cause change in a three dimensional configuration of the garment in response to change in temperature, thereby adjusting insulation performance of the textile fabric.

In another aspect, a temperature response textile fabric garment system includes an inner thermal fabric layer formed of a first, inner textile fabric having a smooth outer surface with one or more regions of a first coating material exhibiting thermal expansion or contraction in response to change in temperature, adjusting insulation performance of the first, inner textile fabric in response to ambient conditions, and having an inner surface towards a wearer's skin. The temperature response textile fabric garment system may also include an outer thermal fabric layer formed of a second, outer textile fabric having a smooth outer surface with one or more regions of an other coating material exhibiting thermal expansion or contraction in response to change in temperature, adjusting insulation performance of the second, outer textile fabric in response to ambient conditions, and having an inner surface towards the smooth outer surface of the inner thermal fabric layer.

Preferred implementations may include one or more of the following additional features. At least one of the first coating material and the other coating material includes polymer that exhibits volume change by crystallization. The polymer is configured to crystallize at a temperature of between about −40° F. and about 100° F. For example, the polymer of the first, inner textile fabric may be configured to crystallize at a temperature of between about 50° F. and about 100° F., e.g., between about 60° F. and about 98° F. and preferably between about 69° F. and about 73° F., and the polymer of the second, outer textile fabric may be configured to crystallize at a temperature of between about −40° F. and about 60° F., e.g., between about −20° F. and about 40° F. The first, inner textile fabric may include one or more regions of second coating material underlying one or more regions of the first coating material, wherein the first coating material and the second coating material exhibit differential thermal expansion to cause change in three-dimensional configuration of the inner thermal fabric layer in response to change in temperature. The second, outer textile fabric may include one or more regions of second coating material underlying one or more regions of the other coating material, wherein the other coating material and the second coating material exhibit differential thermal expansion to cause change in three-dimensional configuration of the outer thermal fabric layer in response to change in temperature.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1A:
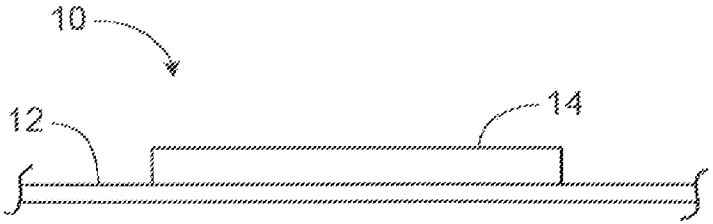
FIGS. 1A-B are cross-sectional views of a textile fabric with a temperature responsive coating material.
Figure 1B:
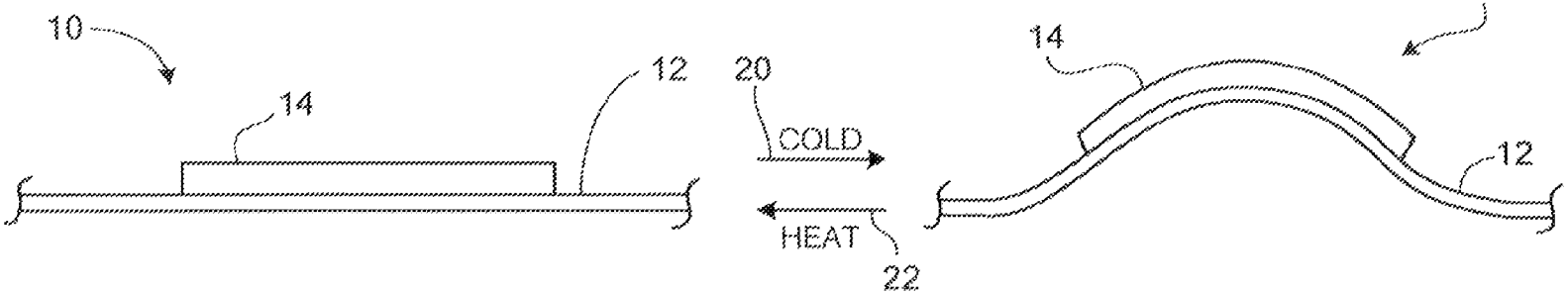

Referring to FIGS. 1A-1B, a temperature responsive smart textile fabric 10 has a smooth, fabric surface 12 with a region of coating material 14. The textile fabric 10 can be circular knit (e.g. single jersey, double knit, and/or terry sinker loop in plaited or reverse plaited construction), warp knit, or woven construction. Preferred textile fabrics contain spandex for enhanced fit, comfort, and shape recovery. As illustrated in FIG. 1B, the coating material responds to change in temperature by exhibiting thermal expansion or contraction, thereby changing the three dimensional configuration of the fabric 10. As shown in FIGS. 1A and B, the coating material 14 is a single polymer layer capable of changing volume through crystallization. The polymer is capable of crystallization in a temperature range of between about −40° F. and about 100° F. In some cases, e.g., where the textile fabric is incorporated next to the wearer's skin or as an inner layer of a garment, the polymer is selected to be capable of crystallization in a temperature range of between about 60° F. to about 98° F. (e.g., a skin temperature range), e.g., between about 69° F. and about 73° F. (e.g., a room temperature range). In some other cases, e.g., where the temperature responsive textile fabric is incorporated as an outer layer in a garment of outerwear, e.g., a jacket and/or an outer shell, for cold weather applications, the polymer preferably is selected to be capable of crystallizing in a temperature range of between about −40° F. and about 60° F., e.g., between about −20° F. and about 40° F.

Preferred materials include shape memory polymer, e.g., polyurethane, which can be designed (formulated) to have a crystalline melting temperature selected from a wide range of temperatures. Crystallization is accompanied by the change in volume. Referring again to FIG. 1B, as the ambient temperature is reduced (indicated by arrow 20) below a threshold temperature, the coating material 14 shrinks (i.e., contracts) and buckles, thereby changing the surface geometry of the fabric 10. This process is also highly reversible (as indicated by arrow 22).

Figure 2A:
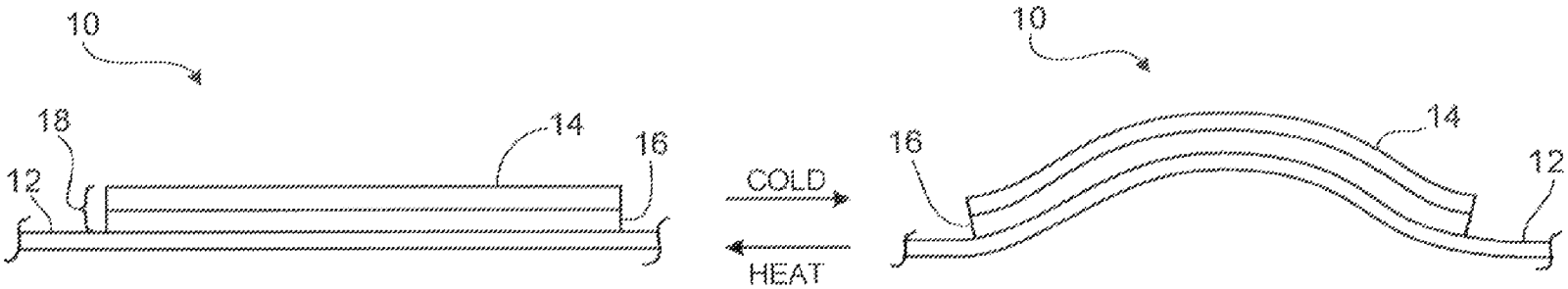
FIGS. 2A-2B are cross-sectional views of a temperature responsive textile fabric with a temperature responsive bi-component coating material.

As shown in FIG. 2A, a second coating material 16 is introduced between the first layer of coating material 14 and the fabric surface 12, forming a bi-component coating layer 18. The second coating material 16 is added to adjust the effect of the first coating material 14 has on the textile fabric 10. For example, in some embodiments, the first layer 14 includes a crystallizing polymer, of the type described above, and the second layer 16 includes a soft rubbery polymer (e.g., polyurethanes, silicones, and/or acrylates). The crystallizing polymer shrinks as the temperature drops below the crystallization temperature (preferably, below 100° F.), while the second polymer remains soft at the same temperature, resulting in differential shrinkage that changes the three dimensional configuration of the textile fabric 10. As a result, a convex dome is formed on the surface of the fabric.

Figure 2B:
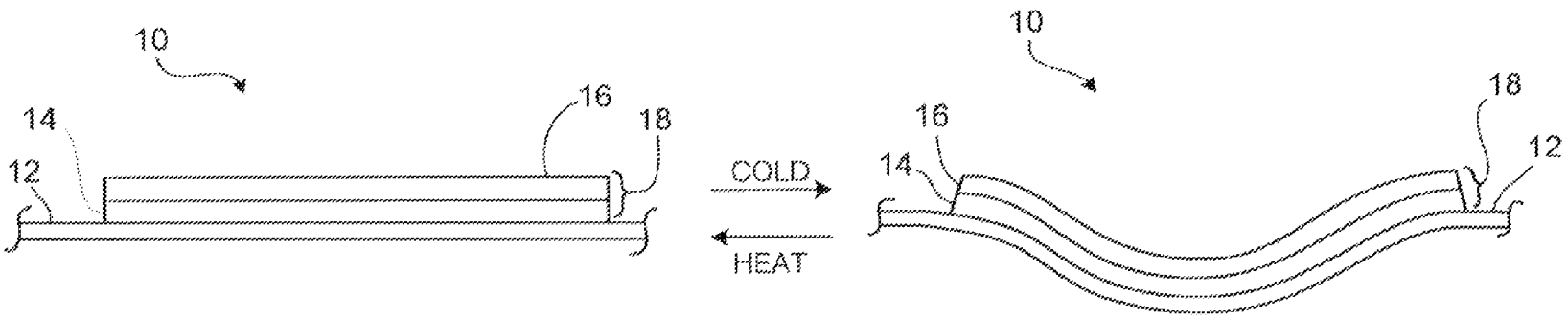

A contrasting effect can be achieved by reversing the sequence of the first and second coating layers 14, 16. As illustrated in FIG. 2B, the sequence of the layers is reversed, placing the first coating material (i.e., crystallizing polymer) in contact with the fabric surface 12, while the second polymer material is disposed above the first polymer material, forming the bi-component coating layer 18. As temperature decreases, the differential shrinkage of the two polymer layers causes a concave dome to form on the surface of the fabric.

Figure 3A:
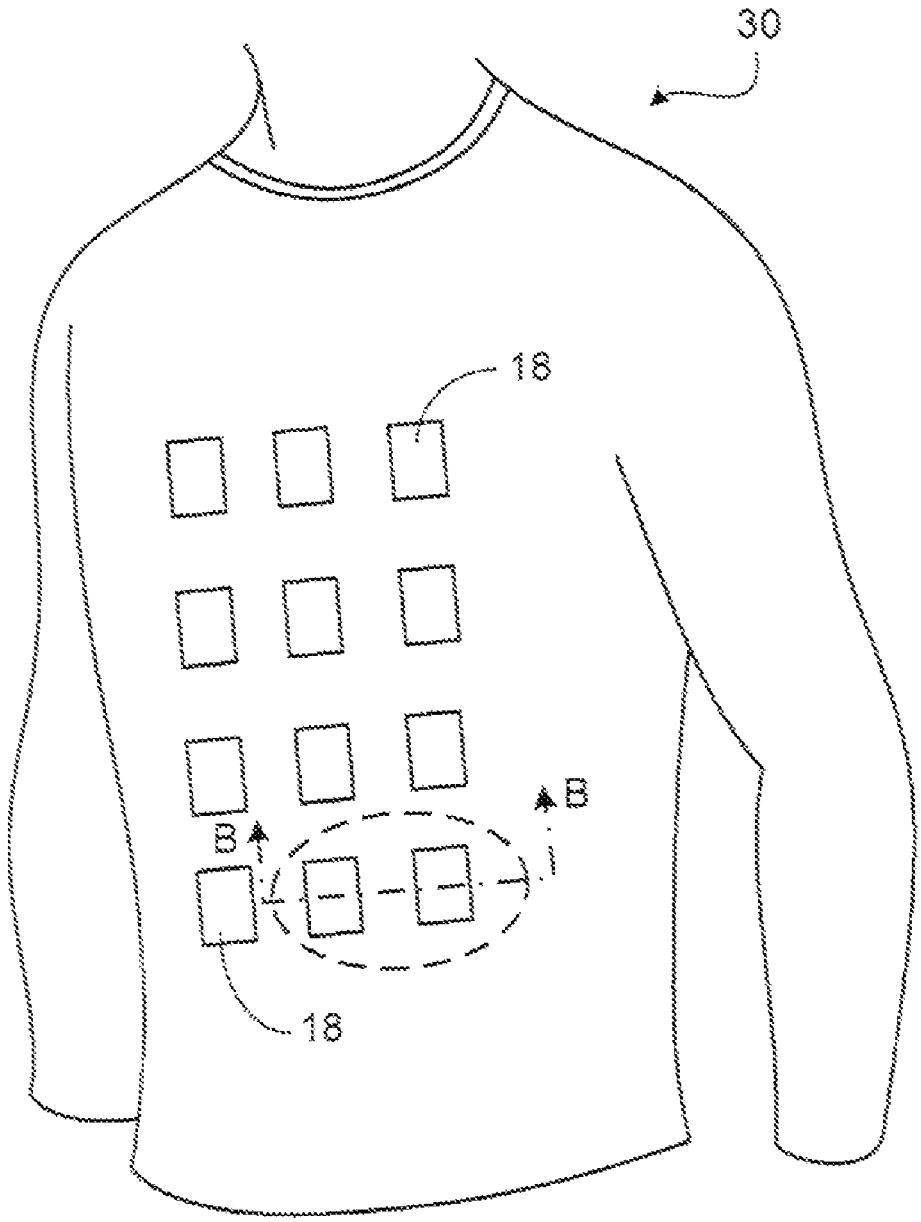
FIG. 3A is a front perspective view of a temperature responsive textile fabric garment.

In the embodiment depicted in FIG. 3A, a temperature responsive textile fabric 10 is incorporated in a fabric garment 30. The temperature responsive garment 30 consists of a fabric formed as a woven or knit textile fabric, e.g. as single jersey, plaited jersey, double knit, or terry sinker loop in plaited or reverse plaited construction, with or without spandex stretch yarn. The textile fabric 10 will preferably still have other comfort properties, e.g. good water management, good stretch recovery, and/or kindness to the wearer's skin. The inner surface of the textile knit fabric, i.e. the surface opposite the wearer's skin, can be raised, e.g. raised terry loop, to reduce the touching points to the skin.

Figure 3B:
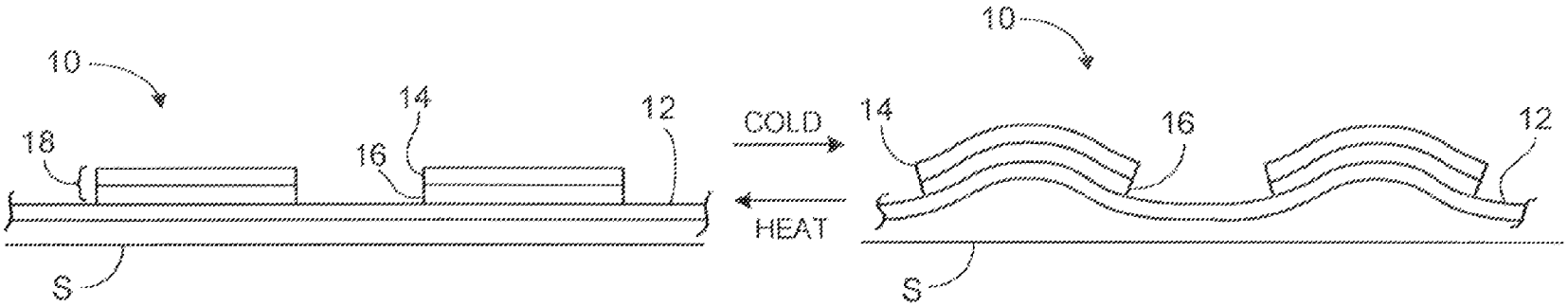
FIGS. 3B-3C are detailed cross-sectional views of the temperature responsive textile fabric garment of FIG. 3A.

A plurality of discrete regions 18 of single component coating (as illustrated for example in FIGS. 1A and 1B) or bi-component coating 18 (as shown, e.g., in FIGS. 3A-3D) are arranged on a smooth outer surface 12 of the garment 30. Referring to FIG. 3B, for example, as the ambient temperature drops, the first and second coating materials 14, 16, of the bi-component coating 18 exhibit differential thermal contraction causing a change in the three dimensional configuration of the textile fabric. More specifically, the change in the three dimensional, configuration of the textile fabric generates, increased bulk, and, as a result, increased thermal insulation, thereby providing enhanced overall, comfort in cooler temperatures. In addition, the change in thee dimensional configuration can reduce clinging of the textile fabric to the user's skin (e.g., when saturated with liquid sweat), thereby to minimize user discomfort.

Figure 3C:
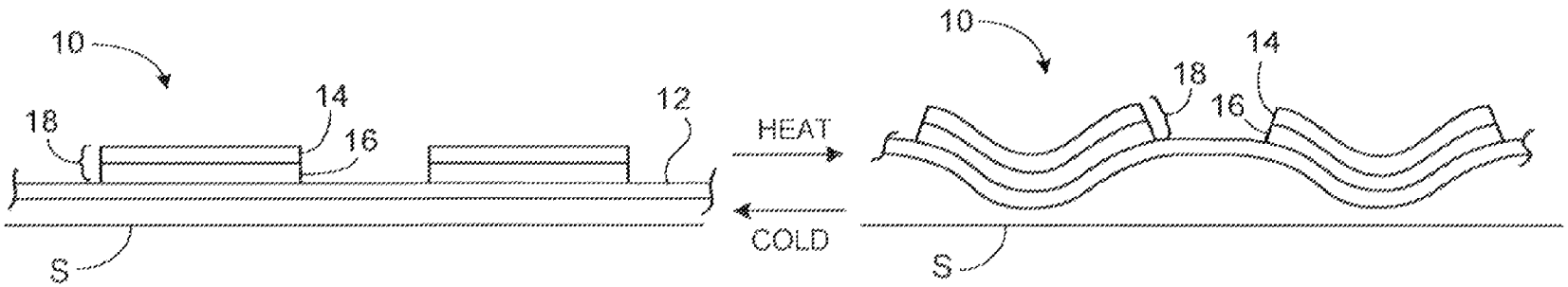

FIG. 3C illustrates the behavior of the fabric garment 30 as the temperature increases above a threshold value. In this example, as the ambient temperature increases, the first and second coating materials 14, 16 of the bi-component coating 18 exhibit differential thermal expansion, again causing a change in the three dimensional configuration of the textile fabric. However, as the ambient temperature increases, the change in the three dimensional configuration of the textile fabric increases the air gap between the user's skin S and the fabric garment 30, thereby allowing increased air flow in the area between the user's skin S and the fabric garment 30, while at the same time reducing the thermal insulation provided by the fabric garment.

Figure 4A:
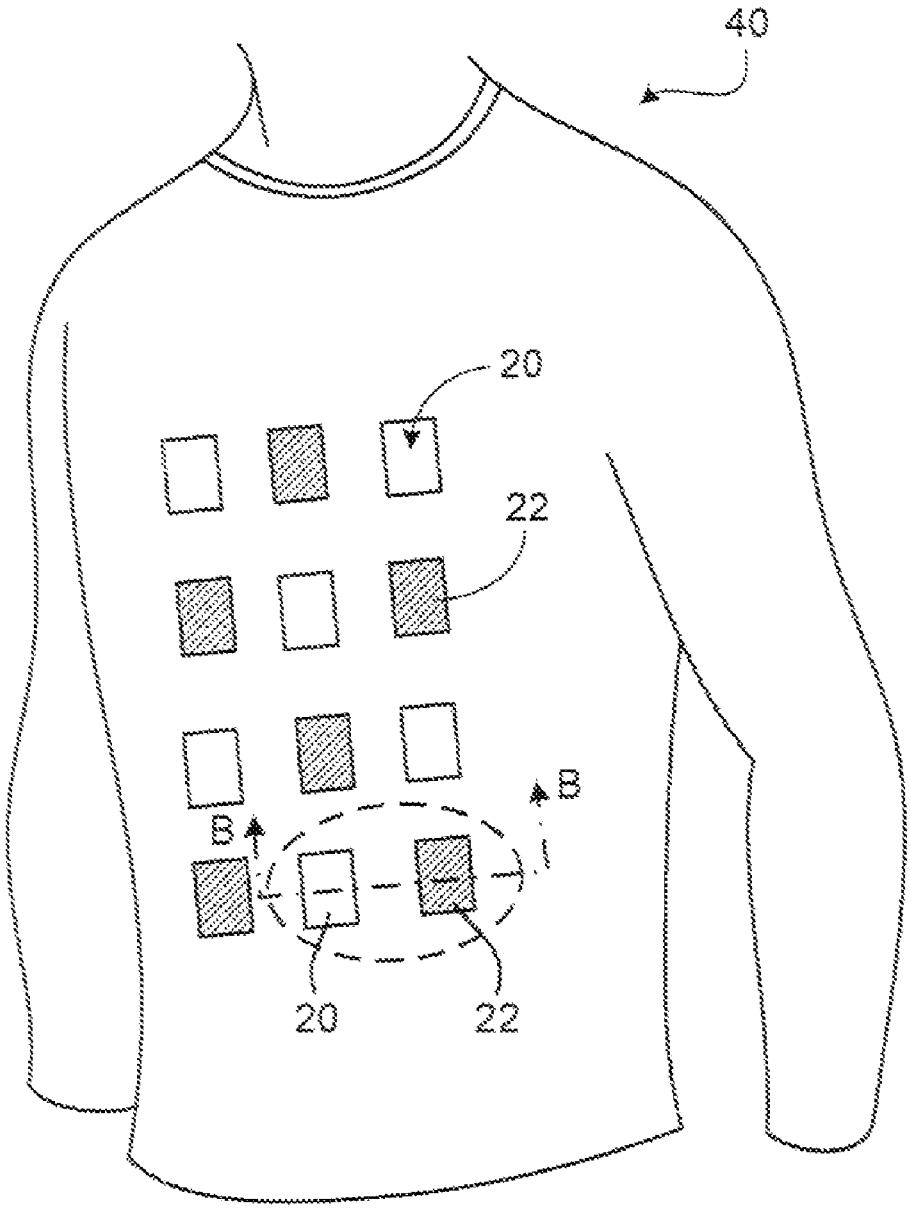
FIG. 4A is a front perspective view a temperature responsive textile fabric having first and second discrete regions of coating that exhibit contrasting thermal elongation/contraction in response to changes in temperature.
Figure 4B:
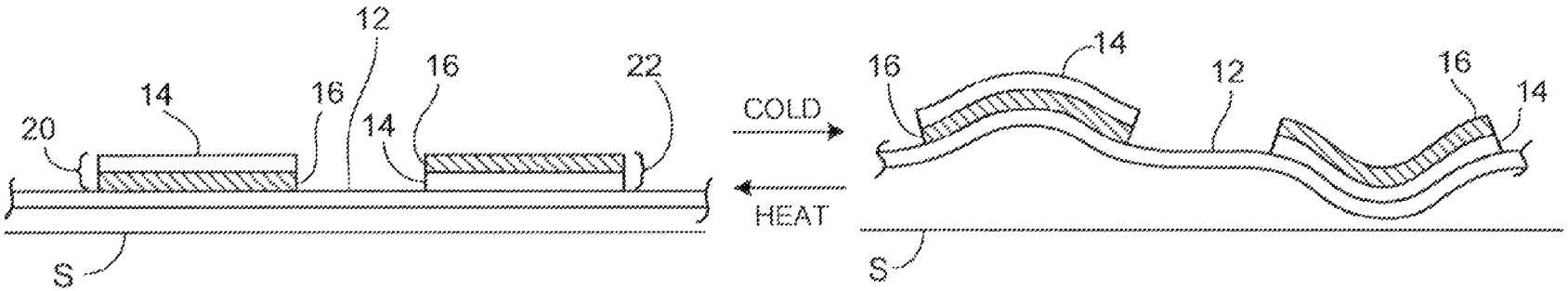
FIG. 4B is a detailed cross-sectional view of the temperature responsive textile fabric garment of FIG. 4A.

FIGS. 4A and 4B illustrate another embodiment in which a temperature responsive textile fabric 10 is incorporated in a fabric garment 40. The temperature responsive fabric garment 40 includes a plurality of first discrete regions of coating 20 and a plurality of second discrete regions of coating 22 disposed on a smooth outer surface of the garment 40, the first and second discrete regions of coating 20, 22 exhibiting differential thermal contraction in response to change in temperature. As shown in FIG. 4B, the first discrete regions of coating 20 are a bi-component coating having a first layer 14, including a crystallizing polymer, and a second layer 16, including a soil rubbery polymer (e.g., polyurethanes, silicones, and/or acrylates). Referring still to FIG. 4B, the second discrete regions of coating 22 are also a bi-component coating; however, the sequence of the layers is reversed, placing the first coating material 14 (i.e., the crystallizing polymer) in contact with the fabric surface 12 while the second polymer material 16 is disposed above the first polymer material 14, forming the second discrete region(s) of bi-component coating 22. In this manner, three dimensional changes in bulk and thermal insulation of the fabric garment can be adjusted as a function of differential thermal expansion/contraction of the selected polymers, and the pattern, and density of the coating regions.

Figure 5A:
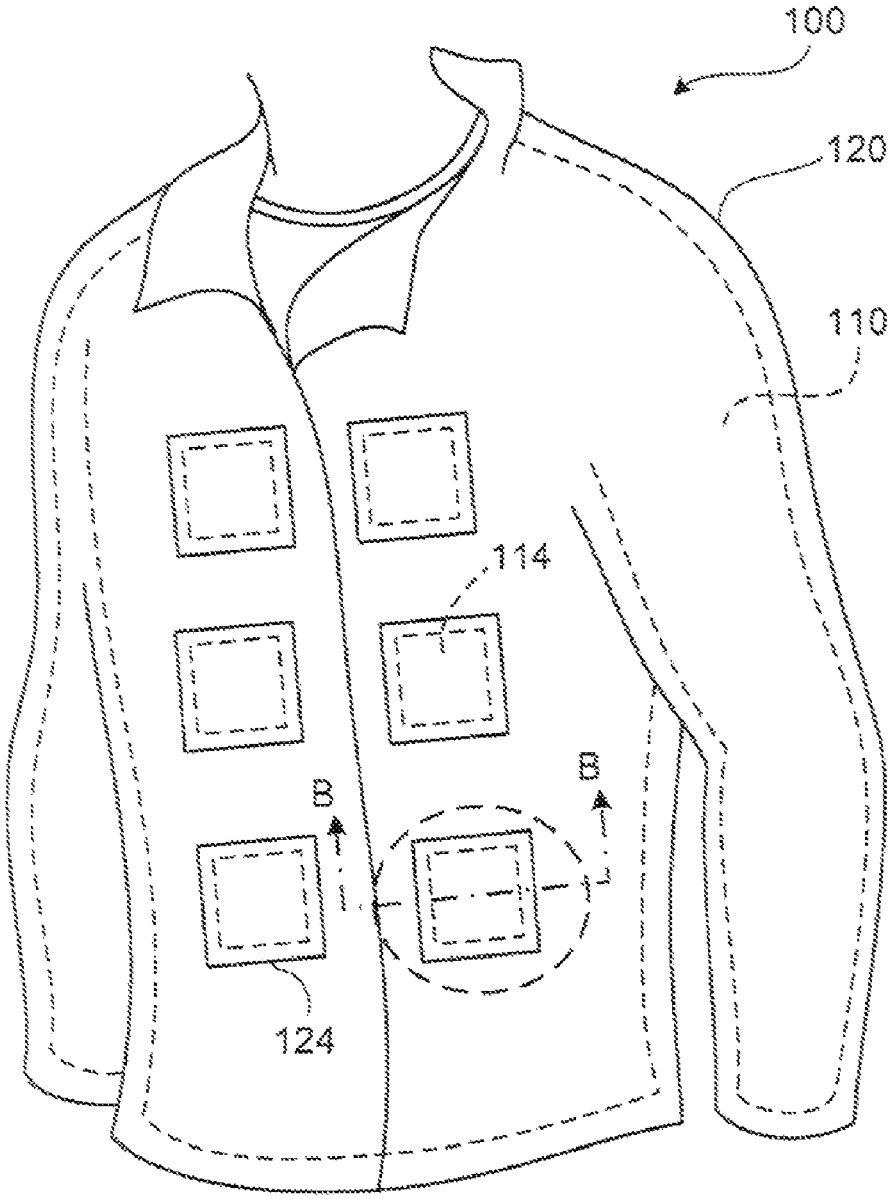
FIG. 5A is a front perspective view of a temperature response textile fabric garment system having inner and outer fabric layers that change in three-dimensional configuration in response to changes in temperature.
Figure 5B:
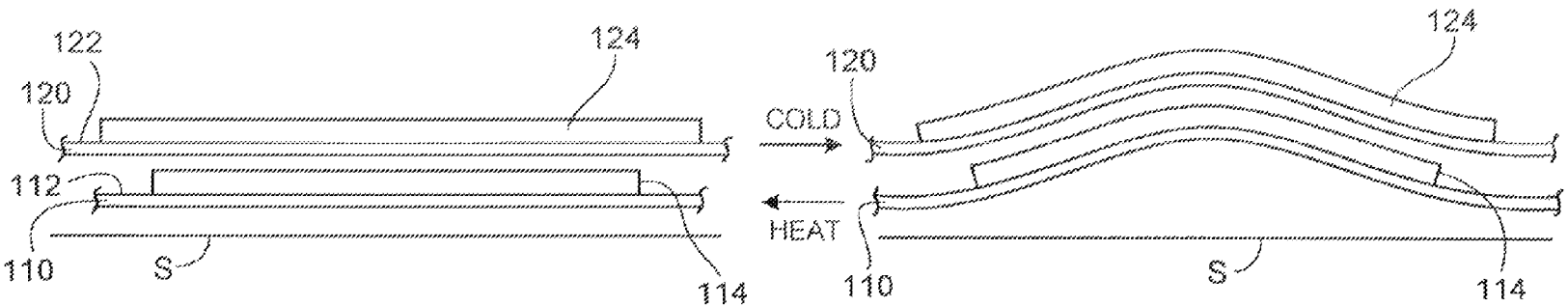
FIGS. 5B and 5C are detailed cross-sectional views of the temperature responsive textile fabric garment system of FIG. 5A.

Referring to FIGS. 5A and 5B, a temperature response textile fabric garment system 100, e.g., as shown, embodied in a jacket constructed for use in cold weather conditions, consists of an inner fabric layer 110 and an outer fabric layer 120. The inner fabric layer 110 is disposed in contact with, or relatively close to, the wearer's skin, when the garment 100 is worn. In contrast, the outer fabric layer 120 is disposed at, or relatively close to, the exterior surface of the garment, and spaced from the wearer's skin, when the garment 100 is worn.

The inner fabric layer has a smooth outer surface 112 with discrete regions of coating material 114. The coating material 114 expands or contracts in response to change in temperature, thereby changing the three-dimensional configuration of the inner fabric layer (as shown, for example, in FIG. 5B) in response to change in temperature, e.g. at a temperature of between about −40° F. and about 60° F., e.g. between about −20° F. and about 40° F., and, as a result, adjusting the insulation performance of the inner fabric layer 110.

The outer fabric layer 120 also includes a smooth outer surface 122 with discrete regions of an other coating material 124. The outer fabric layer 120 may be, for example, a jacket or an outer shell. The other coating material 124 expands or contracts in response to change in temperature, e.g. at a temperature of between about 50° F. and about 100° F., e.g. between about 60° F. and about 98° F., e.g. between about 69° F. and about 73° F., thereby changing the three-dimensional configuration, of the outer fabric layer 120, and, as a result, adjusting the insulation performance of the outer fabric layer 120.

Figure 5C:
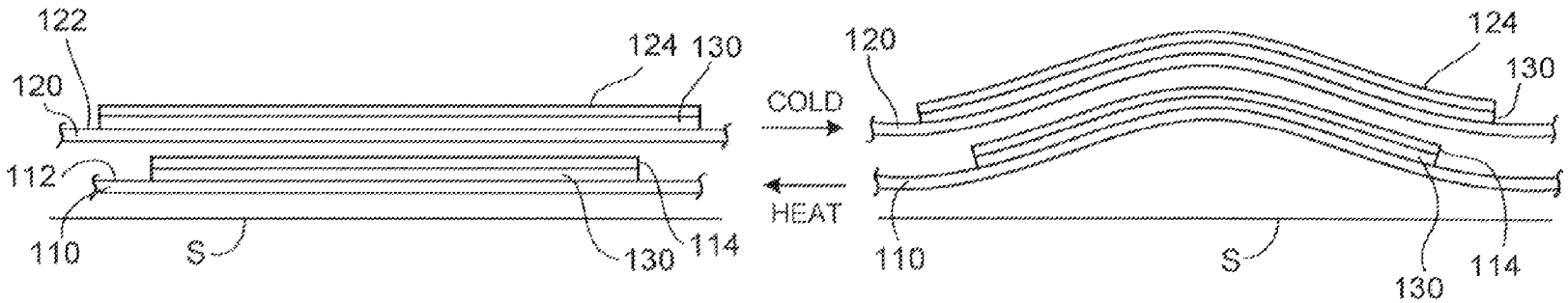

The respective coating materials 114, 124 may be of the type described above with respect to FIGS. 1A and 1B. Referring to FIG. 5C, the inner fabric layer 110 and/or the outer fabric layer 120 may also include a second coating material 130, for example, of the type described above with respect to FIGS. 2A and 2B (i.e., second coating material 16). The second coating material 130 and the coating material 114 exhibit differential thermal expansion in response to change in temperature, thereby adjusting the effect that the coating material 114 has on the inner fabric layer 110. Similarly, the second coating material 130 exhibits differential thermal expansion with respect to the other coating material 124, thereby adjusting the effect of the other coating material 124 on the outer fabric layer 120.

The respective changes in three-dimensional configuration of the inner and outer fabric layers 110 and 120 generate enhanced bulk and increased thermal insulation in response to decrease in the ambient temperature, thereby providing enhanced comfort in cooler climate applications.

A number of embodiments of the invention have been described. Nevertheless, it will be understood that various modifications may be made without departing from the spirit and scope of the invention. For example, the polymer or polymer layers may be applied on a textile fabric garment, in a body mapping pattern. The polymer layers may be applied over high coverage area (i.e., a large part of the surface of the textile fabric is covered), or low coverage area. The polymer or polymer layers may be deposited on the textile fabric utilizing coating, laminating, and/or printing techniques, e.g., hot melt printing, gravure roll, printing, and/or screen printing. The first polymer layer may be applied by itself directly on the fabric or over the second polymer layer. The polymer layers may be deposited on the surface of the textile fabric in side-by-side relationship.

Also, the temperature responsive textile fabric garment system shown in FIG. 5A has a first, inner textile fabric layer responsive in a first range of temperatures and a second, outer textile fabric layer responsive in a second, contrasting range of temperatures. In other embodiments, a temperature responsive textile fabric garment system may have only single fabric layer responsive to temperature or it may have multiple fabric layers responsive to temperature. Also, each fabric layer may be responsive in a desired range or ranges of temperatures selected on the basis of one or more factors, including, e.g., sequential position of the fabric layer in constructions of the garment, expected temperature and other environmental conditions of use, etc.

Accordingly, other embodiments are within the scope of the following claims.

What is claimed is:

1. A textile fabric comprising a textile fabric substrate having a smooth surface with one or more regions of a bi-component coating disposed upon and bonded thereto, said one or more regions of a bi-component coating comprising one or more regions of a first coating material and one or more regions of a second coating material, at least a portion of the first coating material directly contacting and overlying or underlying at least a portion of the second coating material, and, in response to changing temperature, said one or more regions of the first coating material exhibiting a first characteristic thermal expansion or contraction, the first coating material comprising a polymer, the polymer comprising urethane, and the first characteristic thermal expansion or contraction comprising expanding or contracting gradually over a temperature range, and said one or more regions of said second coating material exhibiting a second characteristic thermal expansion or contraction contrasting to said first characteristic thermal expansion or contraction, the second coating material comprising a soft rubbery polymer comprising polyurethanes, silicones, or acrylates and remaining soft over the temperature range, the first coating material and the second coating material exhibiting respectively different thermal expansion or contraction in response to change in temperature over the temperature range, thereby to adjust insulation performance of the textile fabric by changing three dimensional configuration of the textile fabric substrate gradually in response to gradual temperature changes in ambient conditions.

2. The textile fabric of claim 1, wherein said one or more regions of second coating material overlie or underlie said one or more regions of the first coating material.

3. The textile fabric of claim 2, wherein the second coating material is overlying the first coating material, the first coating material is disposed on and bonded to the smooth surface of the textile fabric substrate, and the second coating material is disposed on and bonded to a first surface of the first coating material opposite the smooth surface of the textile fabric substrate.

4. The textile fabric of claim 1, wherein the temperature range is a predetermined temperature range.

5. The textile fabric of claim 4, wherein the predetermined temperature range is between about −40° F. and about 140° F.

6. The textile fabric of claim 5, wherein the predetermined temperature range is between about 50° F. and about 100° F.

7. The textile fabric of claim 5, wherein the predetermined temperature range is between about −40° F. and about 60° F.

8. The textile fabric of claim 7, wherein the predetermined temperature range is between about −20° F. and about 40° F.

9. The textile fabric of claim 2, wherein the second coating material is chemically bonded to the first coating material.

10. The textile fabric of claim 2, wherein the second coating material is physically bonded to the first coating material.

11. The textile fabric of claim 1, wherein the first characteristic thermal expansion or contraction exhibited by the polymer comprises volume change by crystallization over the temperature range.

12. The textile fabric of claim 11, wherein the polymer is configured to crystallize over the temperature range of between about −40° F. and about 100° F.

13. The textile fabric of claim 12, wherein the polymer is configured to crystallize over the temperature range of between about 50° F. and about 100° F.

14. The textile fabric of claim 12, wherein the polymer is configured to crystallize over the temperature range of between about 60° F. and about 98° F.

15. The textile fabric of claim 14, wherein the polymer is configured to crystallize over the temperature range of between about 69° F. and about 73° F.

16. The textile fabric of claim 12, wherein the polymer is configured to crystallize over the temperature range of between about −40° F. and about 60° F.

17. The textile fabric of claim 12, wherein the polymer is configured to crystallize over the temperature range of between about −20° F. and about 40° F.

18. The textile fabric of claim 1, wherein the textile fabric has a construction selected from the group consisting of: circular knit construction, warp knit construction, and woven construction.

19. The textile fabric of claim 1, wherein the textile fabric comprises elastic yarn for enhanced fit, comfort, and shape recovery.

20. The textile fabric of claim 19, wherein the elastic yarn comprises spandex yarn selected from the group consisting of: bare spandex yarn, air entangled yarn, core-spun yarn, and wrap yarn.

21. The textile fabric of claim 1, wherein the textile fabric has a knitting construction selected from the group consisting of single jersey, double knit, and terry loop.

22. The textile fabric of claim 21, wherein the terry loop is formed in plaited construction.

23. The textile fabric of claim 21, wherein the terry loop is formed in reverse plaited construction.

24. The textile fabric of claim 21, wherein the terry loop is raised by napping.

25. The textile fabric of claim 1, wherein the first coating material is disposed in a plurality of predetermined discrete regions on the smooth surface of the textile fabric substrate.

26. The textile fabric of claim 25, wherein the predetermined discrete regions are in the form of discrete dots.

27. The textile fabric of claim 25, wherein the first coating material covers between about 5% and about 80% of surface area of the smooth surface.

28. A method of forming a temperature responsive textile fabric element for use in an engineered thermal fabric garment, the method comprising:

combining yarns and/or fibers to form a continuous web;

finishing the continuous web to form a textile fabric substrate having at least one smooth surface; and disposing on and bonding to one or more regions of the smooth surface a bi-component coating, the bi-component coating on the one or more regions comprising one or more regions of a first coating material and one or more regions of a second coating material, at least a portion of the first coating material directly contacting and overlying or underlying at least a portion of the second coating material, and, in response to changing temperature, the one or more regions of the first coating material exhibiting a first characteristic thermal expansion or contraction, the first coating material comprises a polymer, the polymer comprising urethane, and the first characteristic thermal expansion or contraction comprising expanding or contracting gradually over a temperature range, the one or more regions of the second coating material exhibiting a second characteristic thermal expansion or contraction contrasting to the first characteristic thermal expansion or contraction, the second coating material comprising a soft rubbery polymer comprising polyurethanes, silicones, or acrylates and remaining soft over the temperature range, the first coating material and the second coating material exhibiting respectively different thermal expansion or contraction in response to change in temperature over the temperature range, thereby to adjust insulation performance of the textile fabric by changing three dimensional configuration of the textile fabric substrate gradually in response to gradual temperature changes in ambient conditions.

29. The method of claim 28, wherein the combining yarn and/or fibers in a continuous web comprises combining yarn and/or fibers by circular knitting to form a circular knit fabric.

30. The method of claim 29, wherein the combining yarn and/or fibers in a continuous web by circular knitting comprises combining yarn and/or fibers by reverse plaiting.

31. The method of claim 30, wherein the finishing comprises finishing one surface of the continuous web to form a terry sinker loop construction.

32. The method of claim 29, wherein the combining yarn and/or fibers in a continuous web by circular knitting comprises combining yarn and/or fibers by plaiting.

33. The method of claim 32, wherein the finishing comprises finishing one surface of the continuous web to form a terry sinker loop construction.

34. The method of claim 29, wherein the finishing comprises finishing the continuous web to form a single jersey construction.

35. The method of claim 29, wherein the finishing comprises finishing the continuous web to form a double knit construction.

36. The method of claim 28, wherein the combining yarn and/or fibers in a continuous web comprises combining yarn and/or fibers by warp knitting.

37. The method of claim 28, wherein the combining yarn and/or fibers in a continuous web comprises combining yarn and/or fibers to form a woven fabric element.

38. The method of claim 28, wherein the first coating material is deposited in one or more discrete regions of the smooth surface of the textile fabric substrate.

39. The method of claim 38, wherein the one or more discrete regions are disposed in a pattern corresponding to predetermined areas on an engineered thermal fabric garment typically subjected to relatively high levels of liquid sweat.

40. The method of claim 38, wherein the discrete regions are predetermined and are in the form of discrete dots.

41. The method of claim 28, wherein the first coating material is deposited over substantially the entire smooth surface of the textile fabric substrate.

42. The method of claim 28, wherein the second coating material is deposited to overlie the first coating material, thereby forming the bi-component coating at the smooth surface of the textile fabric substrate.

43. The method of claim 42, further comprising drying the first coating material prior to depositing the second coating material.

44. The method of claim 42, wherein depositing the second coating material comprises depositing the second coating material to overlie one or more regions of the first coating material such that at least a portion of the second coating material is disposed upon the smooth surface of the textile fabric substrate.

45. The method of claim 28, wherein the first coating material is deposited by a process selected from the group consisting of: coating, lamination, and printing.

46. The method of claim 45, wherein printing includes hot melt printing, gravure roll printing, screen printing, or hot melt gravure roll.

47. A temperature responsive textile fabric garment, comprising:

a thermal fabric substrate having a smooth outer surface; and a plurality of discrete regions of a bi-component coating disposed upon and bonded to the smooth outer surface in a pattern corresponding to one or more predetermined regions of a user's body, said one or more regions of a bi-component coating comprising one or more regions of a first coating material and one or more regions of a second coating material, at least a portion of the first coating material directly contacting and overlying or underlying at least a portion of the second coating material, and, in response to changing temperature, the first coating material exhibiting a first characteristic thermal expansion or contraction, the first coating material comprising a polymer, the polymer comprising urethane, and the first characteristic thermal expansion or contraction comprising expanding or contracting gradually over a temperature range, the second coating material exhibiting a second characteristic thermal expansion or contraction contrasting to the first characteristic thermal expansion or contraction the second coating material comprising a soft rubbery polymer comprising polyurethanes, silicones, or acrylates and remaining soft over the temperature range, the first coating material and the second coating material exhibiting respectively different thermal expansion or contraction in response to change in temperature over the temperature range, thereby adjusting insulation performance of the textile fabric by changing three dimensional configuration of the textile fabric substrate gradually in response to gradual temperature changes in ambient conditions.

48. The textile fabric garment of claim 47, wherein the first characteristic thermal expansion or contraction exhibited by the polymer of the first coating material comprises volume change by crystallization.

49. The textile fabric garment of claim 48, wherein the polymer of the first coating material is configured to crystallize over the temperature range of between about −40° F. and about 100° F.

50. The textile fabric garment of claim 49, wherein the polymer of the first coating material is configured to crystallize over a temperature range of between about 60° F. and about 98° F.

51. The textile fabric garment of claim 50, wherein the polymer of the first coating material is configured to crystallize over the temperature range of between about 69° F. and about 73° F.

52. The textile fabric garment of claim 49, wherein the polymer of the first coating material is configured to crystallize over the temperature range of between about −40° F. and about 60° F.

53. The textile fabric garment of claim 52, wherein the polymer of the first coating material is configured to crystallize over the temperature range of between about −20° F. and about 40° F.

54. The textile fabric garment of claim 49 in the form of an article of outerwear.

55. The textile fabric garment of claim 54, wherein the article of outerwear is a jacket.

56. The textile fabric garment of claim 54, wherein the thermal fabric is a substantially flat outer shell material exhibiting the second characteristic thermal expansion or contraction in response to change in temperature, and the polymer of the first coating material exhibits the first characteristic thermal expansion or contraction in response to change in temperature, thereby to cause change in two-dimensional planar configuration of the thermal fabric in response to change in temperature, to increase insulation performance of the textile fabric garment in response to decrease in temperature.

57. The textile fabric garment of claim 47, wherein the thermal fabric comprises spandex yarn for enhanced fit, comfort, and shape recovery.

58. The textile fabric garment of claim 57, wherein the spandex yarn comprises bare spandex yarn, air entangled yarn, core-spun yarn, or wrap yarn.

59. The textile fabric garment of claim 47, wherein the plurality of discrete regions of a second coating material is disposed upon and bonded to the smooth outer surface of the textile fabric substrate, adjacent and corresponding to the plurality of discrete regions of the first coating material, wherein the first coating material and the second coating material exhibit differential thermal expansion to cause a change in three dimensional configuration of the garment in response to change in temperature, thereby adjusting insulation performance of the textile fabric.

60. A temperature response textile fabric garment system, comprising:

an inner thermal fabric layer formed of a first, inner textile fabric substrate having a smooth outer surface with one or more regions of a bi-component coating disposed upon and bonded thereto and having an inner surface towards a wearer's skin, said one or more regions of a bi-component coating comprising one or more regions of a first coating material and one or more regions of a second coating material, at least a portion of the first coating material directly contacting and overlying or underlying at least a portion of the second coating material, and, in response to change in temperature, said one or more regions of first coating material exhibiting a first characteristic thermal expansion or contraction, the first coating material comprising a polymer, the polymer comprising urethane, and the first characteristic thermal expansion or contraction comprising expanding or contracting gradually over a temperature range, said one or more regions of second coating material exhibiting a second characteristic thermal expansion or contraction contrasting to at least the first characteristic thermal expansion or contraction, the second coating material comprising a soft rubbery polymer comprising polyurethanes, silicones, or acrylates and remaining soft over the temperature range, the first coating material and the second coating material exhibiting respectively different thermal expansion or contraction in response to change in temperature over the temperature range, thereby to adjust insulation performance of the first, inner textile fabric substrate by changing three dimensional configuration of the first, inner textile fabric substrate gradually in response to gradual temperature changes in ambient conditions; and an outer thermal fabric layer formed of a second, outer textile fabric substrate having a smooth outer surface with one or more regions of other coating disposed upon and bonded thereto and having an inner surface towards the smooth outer surface of the inner fabric layer, said one or more regions of other coating comprising one or more regions of other coating material, and, in response to change in temperature, said one or more regions of other coating material exhibiting another characteristic thermal expansion or contraction, and said smooth surface of said second, outer textile fabric substrate exhibiting a characteristic thermal expansion or contraction contrasting to said another characteristic thermal expansion or contraction, the first coating material and the second coating material exhibiting respectively different thermal expansion or contraction in response to change in temperature over the temperature range, thereby to adjust insulation performance of the second, outer textile fabric substrate by changing three dimensional configuration of the second, outer textile fabric substrate in response to ambient conditions.

61. The temperature responsive textile fabric garment system of claim 60, wherein the polymer in the first coating material exhibits volume change by crystallization.

62. The temperature responsive textile fabric garment system of claim 61, wherein the polymer is configured to crystallize over the temperature range of between about −40° F. and about 100° F.

63. The temperature responsive textile fabric garment system of claim 62, wherein the polymer of the first, inner textile fabric is configured to crystallize over the temperature range of between about 50° F. and about 100° F.

64. The temperature responsive textile fabric garment system of claim 63, wherein the polymer of the first, inner textile fabric is configured to crystallize over the temperature range of between about 60° F. and about 98° F.

65. The temperature responsive textile fabric garment system of claim 64, wherein the polymer of the first, inner textile fabric is configured to crystallize over the temperature range of between about 69° F. and about 73° F.

66. The temperature responsive textile fabric garment system of claim 60, wherein the other coating material of the second, outer textile fabric comprises a polymer that is configured to crystallize over a temperature range of between about −40° F. and about 60° F.

67. The temperature responsive textile fabric garment system of claim 66, wherein the polymer of the second, outer textile fabric is configured to crystallize over a temperature range of between about −20° F. and about 40° F.

68. A temperature response textile fabric garment system, comprising:

an inner thermal fabric layer formed of a first, inner textile fabric substrate having a smooth outer surface with one or more regions of a first coating disposed upon and bonded thereto and having an inner surface exposed to a wearer's skin, said one or more regions of a first coating comprising one or more regions of a first coating material, and, in response to change in temperature, said one or more regions of first coating material exhibiting a first characteristic thermal expansion or contraction, and said smooth surface of said first, inner textile fabric substrate exhibiting a characteristic thermal expansion or contraction contrasting to said first characteristic thermal expansion or contraction, the first coating material and the first, inner textile fabric substrate exhibiting respectively different thermal expansion or contraction in response to change in temperature over a first temperature range, thereby to adjust insulation performance of the first, inner textile fabric by changing three dimensional configuration of the first, inner textile fabric substrate in response to ambient conditions; and an outer thermal fabric layer formed of a second, outer textile fabric substrate having a smooth outer surface with one or more regions of a bi-component coating disposed upon and bonded thereto and having an inner surface towards the smooth outer surface of the inner fabric layer, said one or more regions of a bi-component coating comprising one or more regions of other coating material and one or more regions of second coating material, at least a portion of the first coating material directly contacting and overlying or underlying at least a portion of the second coating material, and, in response to change in temperature, said one or more regions of other coating material exhibiting another characteristic thermal expansion or contraction, the other coating material comprising a polymer, the polymer comprising urethane, and the another characteristic thermal expansion or contraction comprising expanding or contracting gradually over a second temperature range, said one or more regions of said second coating material exhibiting a second characteristic thermal expansion or contraction contrasting to said another characteristic thermal expansion or contraction, the second coating material comprising a soft rubbery polymer comprising polyurethanes, silicones, or acrylates and remaining soft over the second temperature range, the second, outer textile fabric substrate and the second coating material exhibiting respectively different thermal expansion or contraction in response to change in temperature over the second temperature range, thereby to cause gradual change in three-dimensional configuration of the outer thermal fabric layer in response to gradual change in temperature.

69. The textile fabric of claim 2, wherein the second coating material is underlying the first coating material, the first coating material is disposed on and bonded to a first surface of the second coating material opposite the smooth surface of the textile fabric substrate, and the second coating material is disposed on and bonded to the smooth surface of the textile fabric substrate.

70. The temperature responsive textile fabric garment system of claim 68, wherein the polymer in the other coating material exhibits volume change by crystallization.

71. The temperature responsive textile fabric garment system of claim 70, wherein the polymer is configured to crystallize over the second temperature range of between about −40° F. and about 100° F.

72. The temperature responsive textile fabric garment system of claim 71, wherein the polymer of the other coating material is configured to crystallize over the second temperature range of between about 50° F. and about 100° F.

73. The temperature responsive textile fabric garment system of claim 72, wherein the polymer of the other coating material is configured to crystallize over the second temperature range of between about 60° F. and about 98° F.

74. The temperature responsive textile fabric garment system of claim 73, wherein the polymer of the other coating material is configured to crystallize over the second temperature range of between about 69° F. and about 73° F.

75. The temperature responsive textile fabric garment system of claim 68, wherein the first coating material of the first, inner textile fabric comprises a polymer that is configured to crystallize over the first temperature range of between about −40° F. and about 60° F.

76. The temperature responsive textile fabric garment system of claim 75, wherein the polymer of the first coating material is configured to crystallize over the first temperature range of between about −20° F. and about 40° F.

77. The textile fabric of claim 1, wherein the change of three dimensional configuration of the textile fabric substrate is reversible.

78. The textile fabric garment of claim 47, wherein the change of three dimensional configuration of the textile fabric substrate is reversible.

79. The temperature response textile fabric garment system of claim 60, wherein the change of three dimensional configuration of the first, inner textile fabric substrate is reversible.

80. The temperature response textile fabric garment system of claim 68, wherein the change of three dimensional configuration of the first, inner textile fabric substrate and the change of three dimensional configuration of the outer thermal fabric layer are reversible.

* * * * *

UNITED STATES PATENT AND TRADEMARK OFFICE

CERTIFICATE OF CORRECTION

PATENT NO. : 8,187,984 B2
APPLICATION NO. : 11/740716
DATED : May 29, 2012
INVENTOR(S) : Moshe Rock It is certified that error appears in the above-identified patent and that said Letters Patent is hereby corrected as shown below:

Title Page 3, Other Publications, line 1, delete "Apparal" and insert -- Apparel --, therefor.

Column 1, line 26-27, delete "smooth-surface" and insert -- smooth surface --, therefor.

Column 1, line 32, delete "cars" and insert -- can --, therefor.

Column 1, line 64, delete "second," and insert -- second --, therefor.

Column 2, line 3, delete "eases," and insert -- cases, --, therefor.

Column 2, line 43, delete "web;" and insert -- web --, therefor.

Column 4, line 5, delete "costing" and insert -- coating --, therefor.

Column 5, line 22, delete "smooth," and insert -- smooth --, therefor.

Column 5, line 24, delete "(e.g." and insert -- (e.g., --, therefor.

Column 6, line 35, delete "dimensional," and insert -- dimensional --, therefor.

Column 6, line 35, delete "generates," and insert -- generates --, therefor.

Column 6, line 37, delete "overall," and insert -- overall --, therefor.

Column 6, line 38, delete "thee" and insert -- the --, therefor.

Column 7, line 10, delete "pattern," and insert -- pattern --, therefor.

Column 7, line 38, delete "configuration," and insert -- configuration --, therefor.

Column 7, line 64, delete "garment," and insert -- garment --, therefor.

Column 8, line 3, delete "roll," and insert -- roll --, therefor.

Column 11, line 28-44, delete "a plurality of discrete regions of a bi-component coating disposed upon and bonded to the smooth outer surface in a pattern corresponding to one or more predetermined regions of a user's body, said one or more regions of a bi-component coating comprising one or more regions of a first coating material and one or more regions of a second coating material, at least a portion of the first coating material directly contacting and overlying or underlying at least a portion of the second coating Signed and Sealed this
Fourteenth Day of August, 2012

David J. Kappos

David J. Kappos
*Director of the United States Patent and Trademark Office* material, and, in response to changing temperature, the first coating material exhibiting a first characteristic thermal expansion or contraction, the first coating material comprising a polymer, the polymer comprising urethane, and the first characteristic thermal expansion or contraction comprising expanding or contracting gradually over a temperature range,"

and insert -- a plurality of discrete regions of a bi-component coating disposed upon and bonded to the smooth outer surface in a pattern corresponding to one or more predetermined regions of a user's body, said one or more regions of a bi-component coating comprising one or more regions of a first coating material and one or more regions of a second coating material, at least a portion of the first coating material directly contacting and overlying or underlying at least a portion of the second coating material, and, in response to changing temperature, the first coating material exhibiting a first characteristic thermal expansion or contraction, the first coating material comprising a polymer, the polymer comprising urethane, and the first characteristic thermal expansion or contraction comprising expanding or contracting gradually over a temperature range, --, therefor.